US005499775A

United States Patent [19]

Vander Groef

[11] Patent Number: 5,499,775

[45] Date of Patent: Mar. 19, 1996

[54] WINDING MACHINE WITH PROGRAMMABLE TRAVERSE CONTROL

[75] Inventor: Robert L. Vander Groef, North Haledon, N.J.

[73] Assignee: Communication Cable, Inc., Sanford, N.C.

[21] Appl. No.: 96,460

[22] Filed: Jul. 26, 1993

[51] Int. Cl.[6] ..... B65H 54/28

[52] U.S. Cl. ..... 242/158 B; 242/163

[58] Field of Search ..... 242/158 R, 158 B, 242/163, 25 R

[56] References Cited

U.S. PATENT DOCUMENTS

| | | | |
|---|---|---|---|
| 3,544,019 | 12/1970 | Lapidas | 242/158 B |
| 3,747,861 | 7/1973 | Wagner et al. | 242/163 |
| 4,485,978 | 12/1984 | O'Connor | 242/158 R |
| 4,681,275 | 7/1987 | Honczarenko | 242/158 B |
| 4,738,406 | 4/1988 | Lothamer | 242/158 R |
| 4,948,057 | 8/1990 | Greis | 242/158 B |
| 5,009,373 | 4/1991 | Hester | 242/158 R |

*Primary Examiner*—John P. Darling
*Attorney, Agent, or Firm*—Rhodes, Coats & Bennett

[57] ABSTRACT

A winding machine for winding wire includes a spindle on which a spool is mounted, and a reciprocating traverse for guiding an advancing wire onto the spool. The motion of the traverse is controlled by a programmable motion controller. A cam profile is stored in the controller's memory which defines the relationship between the traverse position and the angular position of the spindle. A periodic rotation signal is generated indicative of the angular position of the spindle. In response to each periodic rotation signal, the programmable controller determines the corresponding position of the traverse as set forth in the cam profile and produces a control signal which causes the traverse to move to the commanded position. Gear ratios between the spindle motor and traverse motor are supported.

23 Claims, 15 Drawing Sheets

WINDING MACHINE WITH PROGRAMMABLE TRAVERSE CONTROL

FIELD OF THE INVENTION

The present invention relates generally to winding machines for winding a cable, and more particularly to a programmable traverse control for a winding machine.

BACKGROUND OF THE INVENTION

Many types of wire and cable are sold in coreless packages. The term "package" is a term of art which refers to the coil of wire itself. One common form of package is known as a figure 8 package. This type of package includes a plurality of windings with each winding crossing itself to form a figure 8. The cross-overs of successive windings are angularly displaced and progress around the circumference of the package. The cross-overs do not progress a full 360° around the coil so that a radial opening is formed extending to the axial opening of the package. The configuration of the package permits the wire to be paid out without kinking or twisting. The twistless pay out is due to the manner in which the wire is wound. The twist in each half of the Figure 8 winding is offset by the opposite twist of the winding in the other half. Thus, there would be no substantial twisting of the wire as it is paid out.

The machine for producing a figure 8 package includes a spindle which is rotated to wind the wire onto a mandrel or spool, and a guide which is reciprocated back-and-forth parallel to the axis of the spindle to lay the wire on the spool in a series of figure-8s. The stroke of the traverse is slightly out of phase with the rotation of the spool so that the cross-overs progress around the mandrel.

To form the radial opening, the motion of the traverse is alternately advanced and retarded with respect to the spindle for a predetermined number of rotations of the spindle. The number of rotations is selected so that the cross-overs never advance a full 360° around the spindle. Thus, a radial hole will be formed at the point where no cross-overs are made.

In prior art winding machines, various scalar quantities had to be set by the operator. The scalar quantities would vary depending on the size of wire to be wound, the density of the package, and the desired dimensions of the package. The scalar quantity set by the user are interrelated so that changes in one scalar quantities might cause changes in another scalar quantity. This interrelationship makes it nearly impossible to predict with any accuracy what changes might be caused by changes in any one scalar quantity. The operator is forced to rely on trial and error to find the optimum scalar quantities for any given size wire. Thus, it can take a relatively long period of time to properly set up the winding machine.

Another problem with prior art winding machines is that the radial hole formed is frequently curved or disposed at an angle from a radial. Also, the radial hole is not uniform in size. These factors make unwinding more difficult and may even cause kinking of the wire.

Another problem with prior art winding machines is that it is not possible to stop the winding process to inspect the wire and then restart the winding process at the point where it was stopped. In most prior art winding machines, the portion of the wire already wound would have to be unwound from the coil and the process started all over from the beginning.

SUMMARY AND OBJECTS OF THE INVENTION

The winding machine is designed to wind wire into a package having a radial hole through which the inner end of a wire is paid out. The spindle having a spool mounted thereon is driven by a first electric motor. A line guide is mounted on a traverse which reciprocates in a direction parallel to the axis of the spindle. The traverse is driven by a second electric motor. The guide is reciprocated so as to lay wire on the spindle in a series of cross-over windings in which the wire crosses over itself during each stroke of the traverse. For purposes of this application, the term "stroke" means one complete reciprocation of the traverse. To produce a figure -8 winding with a single cross-over, the traverse should complete approximately 1 stroke for every 2 revolutions of the spindle. The stroke of the traverse is slightly out of phase with the rotation of the spindle so that the cross-over point (i.e. the point where the wire crosses itself) progresses around the mandrel. For example, if the spindle makes 80 complete revolutions, the traverse might complete 49 strokes (retarded) or 51 strokes (advanced). The angular displacement between successive cross-overs would then be approximately 14.6° in advance mode and 14.1° in retarded mode. The motion of the traverse is advanced with respect to the rotation of the spindle for a predetermined number of reciprocations. When the traverse is in an advance mode, the cross-overs progress in a first direction around the mandrel. After the predetermined number of reciprocations is completed, the motion of the traverse is retarded with respect to the rotation of the spindle. In the retard mode, the cross-overs progress in the opposite direction around the mandrel. The number of reciprocations is selected so that the cross-overs never advance a full 360° around the mandrel. Thus, a radial hole is formed in the package through which the inner end of the wire can be paid out.

The motion of the traverse is synchronized with the spindle by a programmable motion controller. A profile representing the position of the traverse with respect to the angular position of the spindle is stored in the programmable motion controller's memory. An encoder monitors the position of the spindle and generates a rotation signal that is transmitted to the programmable motion controller. A resolver monitors the position of the traverse motor and transmits a position feedback signal to the controller. Each time a rotational signal is received by the programmable motion controller, the corresponding position of the traverse motor is determined based on the stored profile and a control signal is generated which causes the traverse motor to move to the commanded position. Thus, the programmable motion controller acts like a "electronic cam" to maintain the position of the traverse with respect to the angular position of the spindle.

Other objects and advantages of the present invention will become apparent and obvious from a study of the following description and the accompanying drawings which are merely illustrative of such invention.

DETAILED DESCRIPTION OF THE INVENTION

Figure 1:
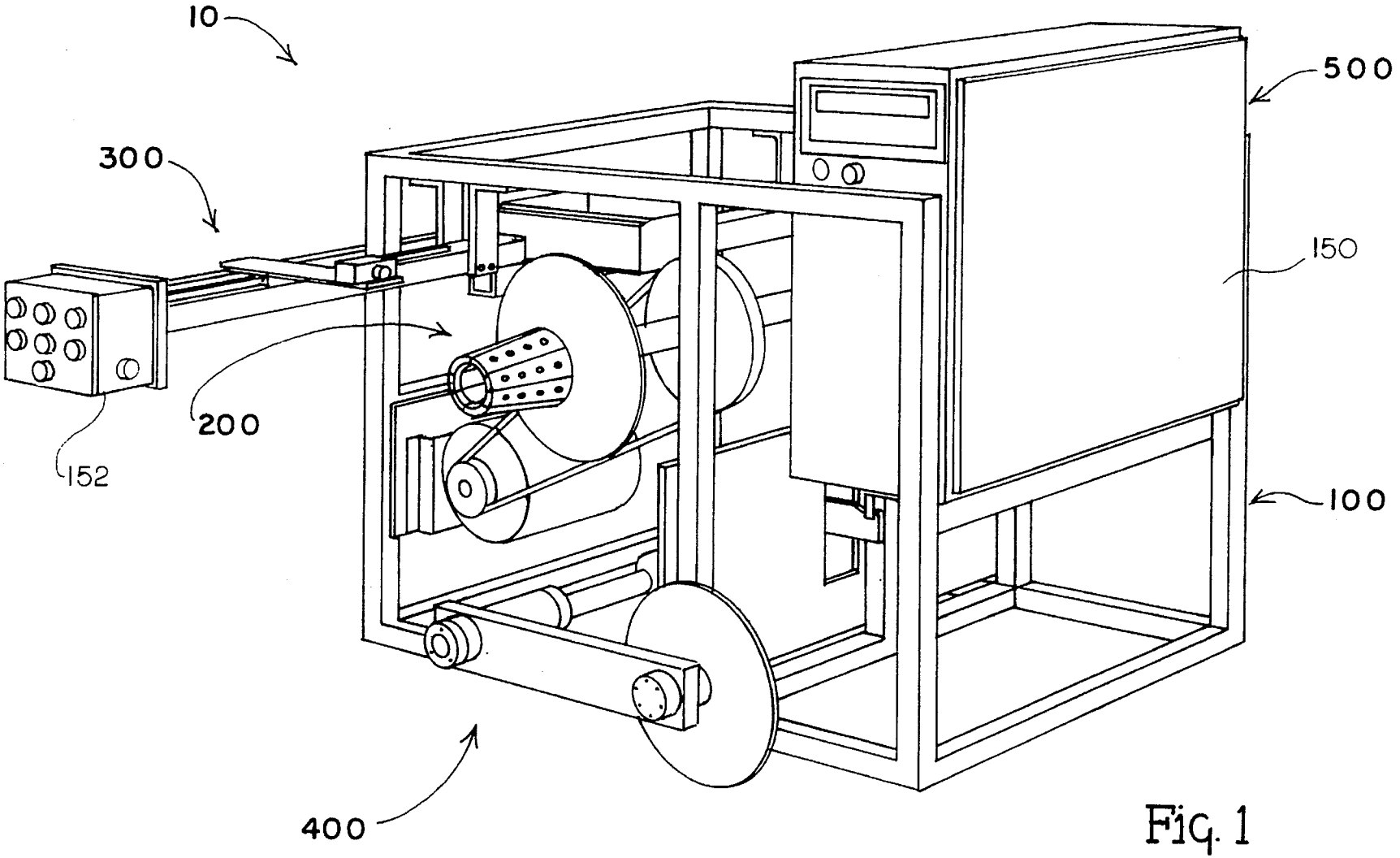
FIG. 1 is a perspective view of the winding machine of the present invention.
Figure 2:
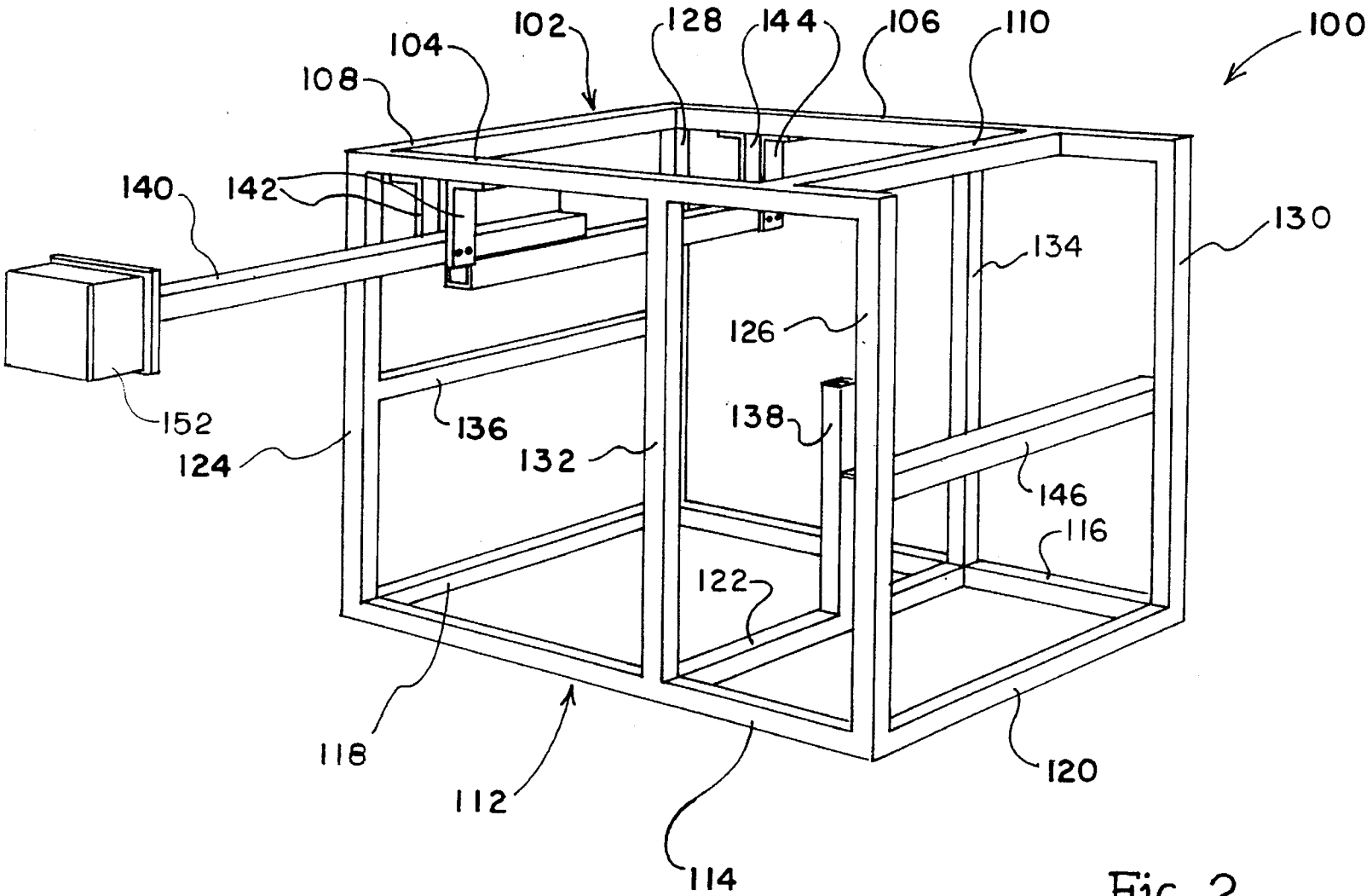
FIG. 2 is a perspective view illustrating the frame of the winding machine.

Referring now to the drawings, the winding machine of the present invention is shown therein and indicated generally by the numeral 10. The winding machine 10 includes five major systems—a frame 100, a spindle assembly 200, a traverse assembly 300, an automatic mandrel loading system 400, and an electronic control system 500.

The frame 100 includes a top frame indicated generally at 102 and a base frame indicated generally at 112. The top frame includes front member 104, a back member 106, and two side members 108 and 110 interconnecting the front and back members and 106. Side member 108 interconnects respective ends of the front and back members 104 and 106. The other side member 110 is spaced inwardly from the opposite ends of the front and back members 104 and 106 to provide space for mounting the control cabinet 150.

The base frame 112 includes a front member 114, a back member 116, and side members 118 and 120. The side members 118 and 120 extend between and interconnect respective ends of the front and back members 114 and 116. A central member 122 is disposed intermediate the side members 118 and 120 and extends between the front and back members 114 and 116.

The top frame 102 and base frame 112 are interconnected by a plurality of uprights 124–130. Uprights 124 and 126 extend between and interconnect the front members 104 and 114. Support member 132 is disposed intermediate uprights 124 and 126 and extends between the front members 104 and 114. Uprights 128 and 130 extend between and interconnect respective ends of the back members 106 and 116. Support member 134 is disposed intermediate uprights 128 and 130 and interconnects the back members 106 and 116.

A support post 138 extends upwardly from the central member 122 of the base frame 112 between support members 132 and 134 for supporting the mandrel loading system 400. A horizontal support 136 extends between the vertical uprights 124 and 128 for supporting the spindle motor 208. A traverse support arm 140 for supporting the traverse system 300 is suspended from the top frame 102. The traverse support arm 140 is connected to the front member 104 by a pair of front hangers 142, and to the back member 106 by a rear hanger 144.

Figure 3:
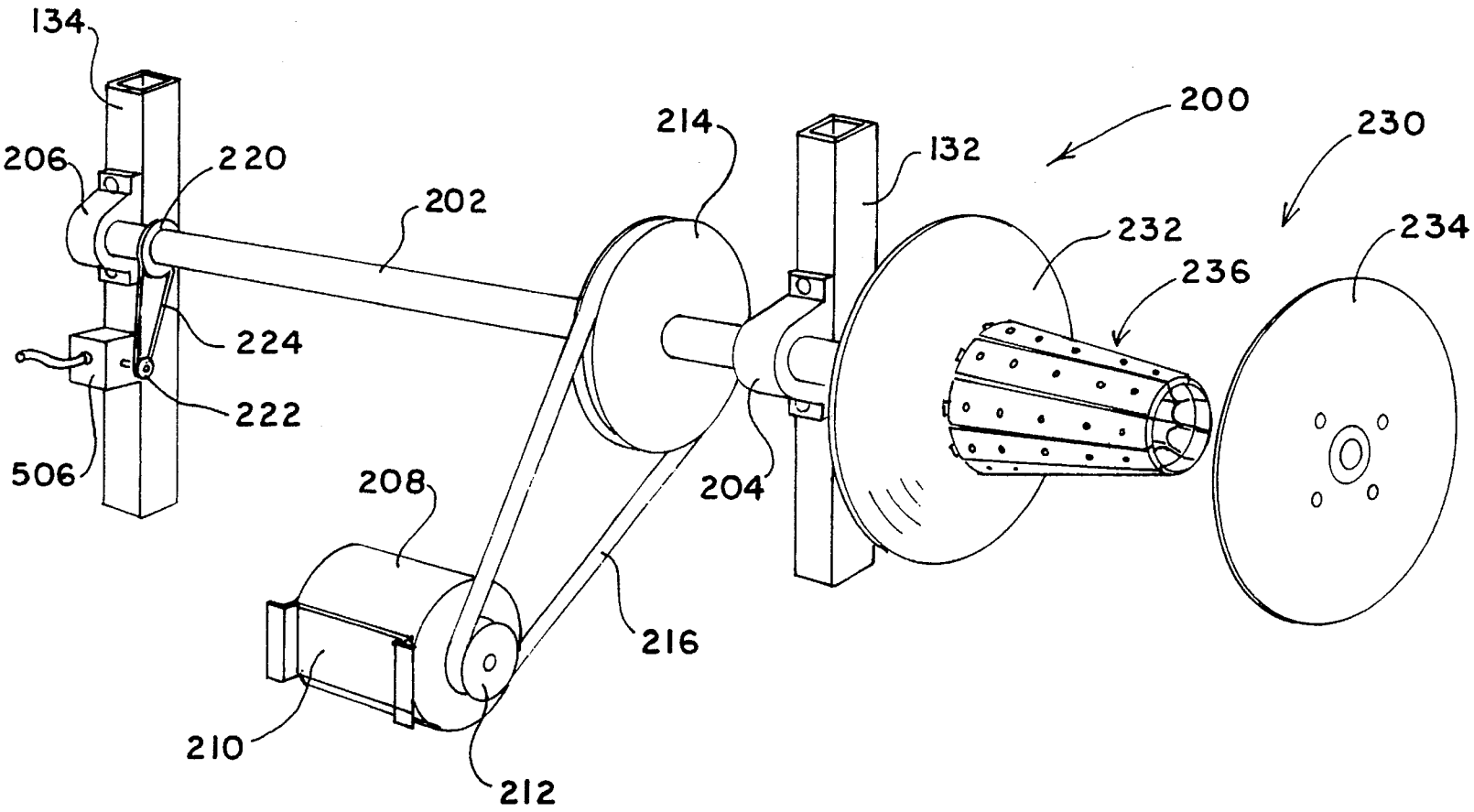
FIG. 3 is a perspective view of the spindle assembly of the winding machine.

Referring now to FIG. 3, the spindle assembly 200 is shown therein. The spindle assembly 200 includes a spindle 202 which is rotatably mounted within a pair of pillow blocks 204 and 206. Pillow blocks 204 and 206 are mounted to the support members 132 and 134 respectively. The spindle 202 is driven by a spindle motor 208. The motor 208 is supported by a mount 21 0 which is attached by the horizontal support 136. The motor 208 is operatively connected to the spindle 202 by a belt drive assembly. The belt drive assembly consists of a motor pulley 212 mounted on the output shaft of the motor 208, and a spindle drive pulley 214 mounted on the spindle 202. A drive belt 216 is entrained around the motor pulley 212 and spindle drive pulley 214 to rotate the spindle 202 when the motor 208 is energized. Mounted on a front end of the spindle 202 is a spool or mandrel 230. The mandrel 230 includes an inner flange 232 and a tapered mandrel core 236.

The rotation of the spindle 202 is monitored by an encoder 506. A belt drive interconnects the spindle 202 and encoder 506. An auxiliary drive pulley 220 is mounted on the spindle 202 and an encoder pulley 222 is mounted to the input shaft of the encoder 506. A drive belt 224 is entrained around the auxiliary drive pulley 220 and the encoder pulley 222. Preferably, the input shaft of the encoder 506 will make two complete revolutions for every revolution of the spindle 202.

The output of the encoder 506 is supplied to the programmable motion controller 502 which uses the signal from the encoder 506 to determine the correct position of the traverse 302.

Figure 4:
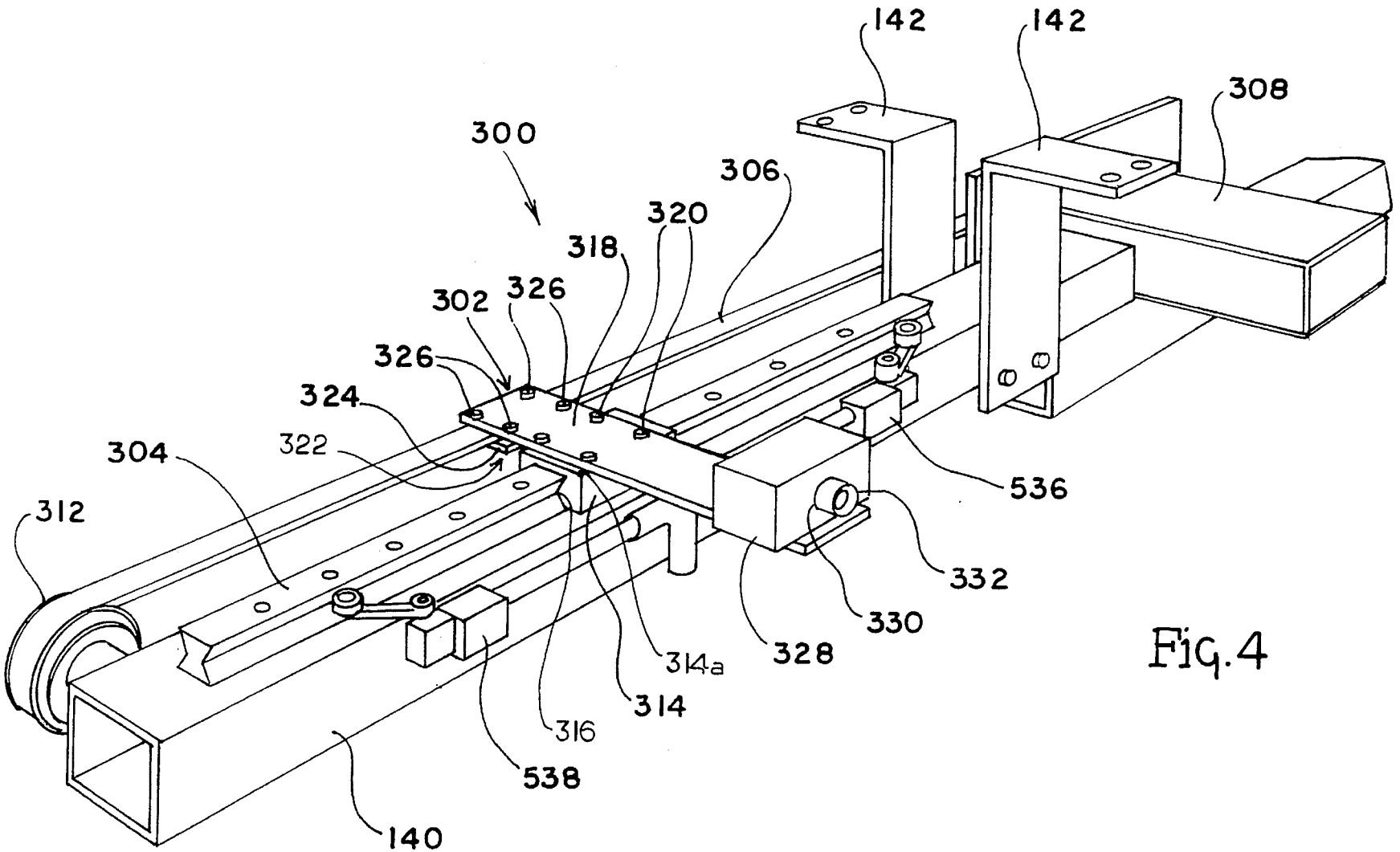
FIG. 4 is a perspective view of the traverse assembly of the winding machine.
Figure 5:
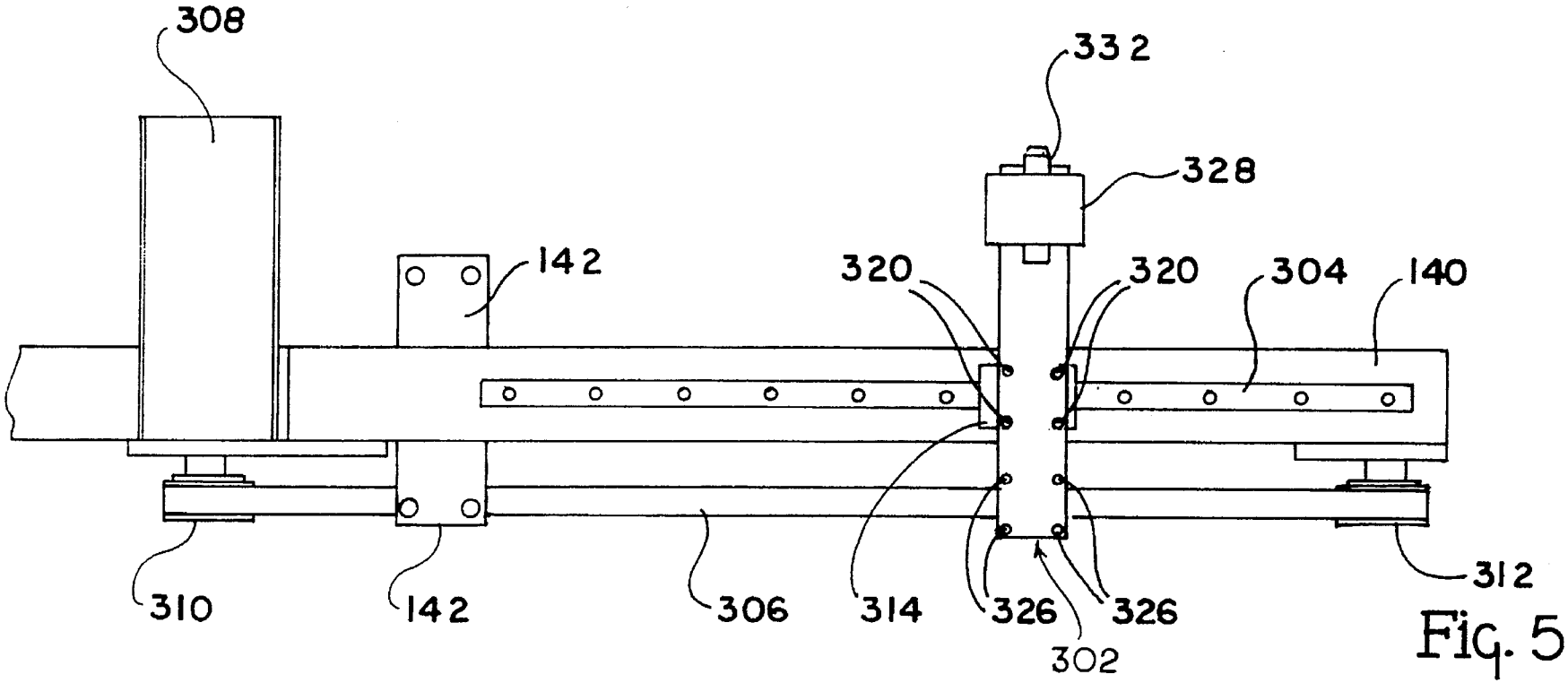
FIG. 5 is a plan view of the transverse assembly of the winding machine.
Figure 6:
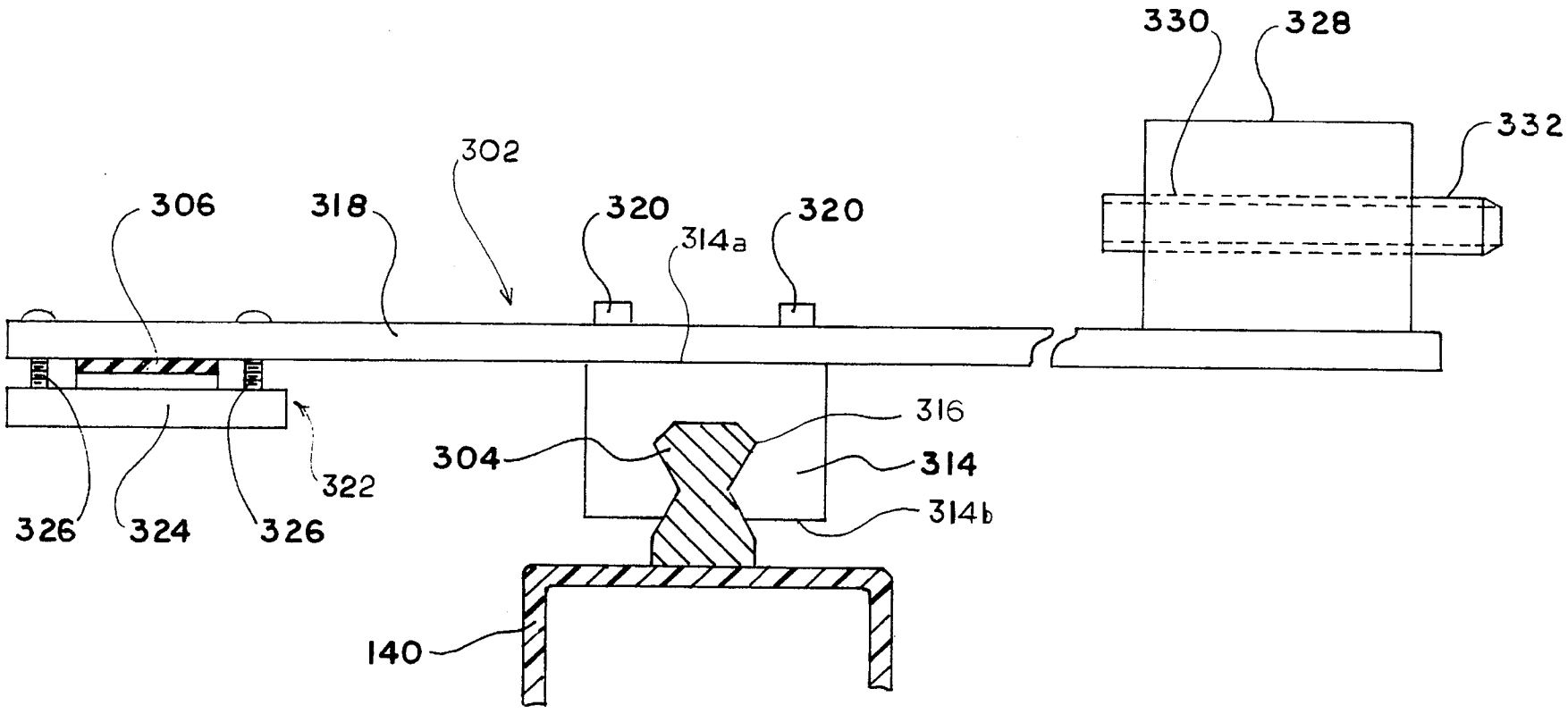
FIG. 6 is an elevation view of the traverse assembly of the winding machine.

Referring now to FIGS. 4–6, the traverse assembly 300 is shown. The traverse assembly 300 includes a sliding traverse 302 which reciprocates along a path parallel to the axis of the spindle 202. The traverse 302 is slidably mounted on a track 304 which is mounted on the traverse support arm 140. The track 304 has generally V-shaped sides. The traverse 302 is clamped to a drive belt 306 which is driven by a servo-motor 308. The belt 306 is entrained at one end around a drive pulley 310, which is mounted on the output shaft of the servo-motor 308, and at the opposite end around an idler pulley 312. The servo-motor 308 is under the control of the programmable motion controller. When a servo-motor 308 receives a control signal from the motion controller, it rotates to position the traverse 302 at the commanded position. The operation of the servo-motor 308 is described in more detail in connection with the control system 500.

The traverse 302 comprises a slide block 314 having a top surface 314*a* and a bottom surface 314*b*. The bottom surface 314*b* of the slide block 314 is formed with a channel 316. The side walls of the channel 316 have a generally V-shaped configuration which correspond to the V-shaped sides of the track 304. The V-shaped configuration of the track 304 and channel 316 prevents the slide block from derailing. A carrier 318 is secured to the slide block 314 by bolts 320. The carrier 318 is also connected to the belt 306 by a clamp 322. The clamp 322 includes a clamping plate 324 which is disposed on the opposite side of the belt 306 from the carrier 318. A plurality of clamping screws 326 are used to draw the clamping plate 324 towards the carrier 318 to sandwich the belt 306 between them.

A guide block 328 is mounted to the carrier 318 at the end opposite the clamp 322. The guide block 328 has a guide opening 330 formed therein which is fitted with a guide tube 332. During operation of the winding machine, the advancing wire is fed towards the spindle 202 through a guide tube 332 while the traverse reciprocates along a path parallel to the axis of the spindle 202 to lay the line on the mandrel. The operation of the traverse 302 is described in more detail below.

Figure 7:
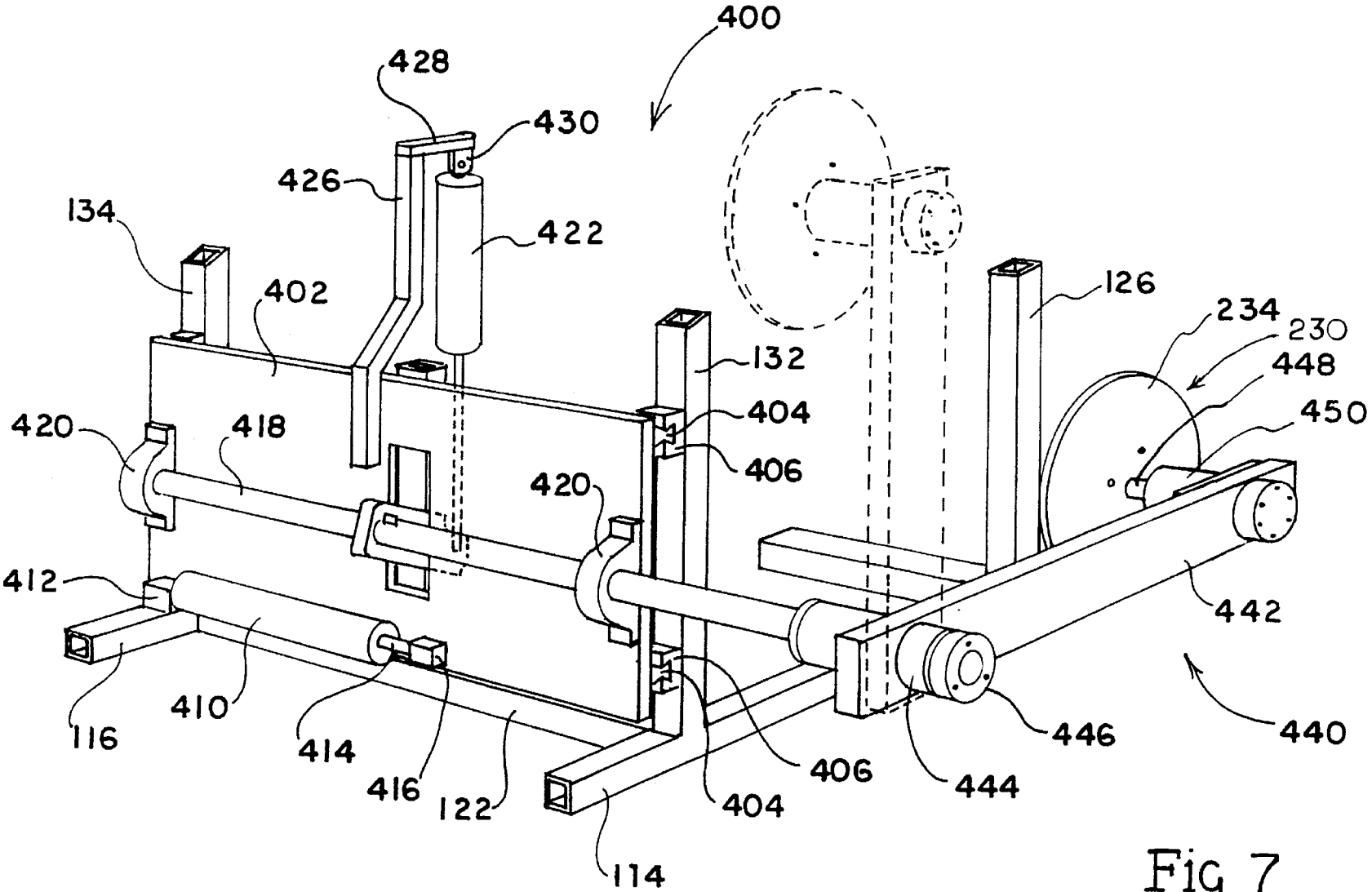
FIG. 7 is a perspective view of mandrel-loading system of the winding machine.
Figure 8:
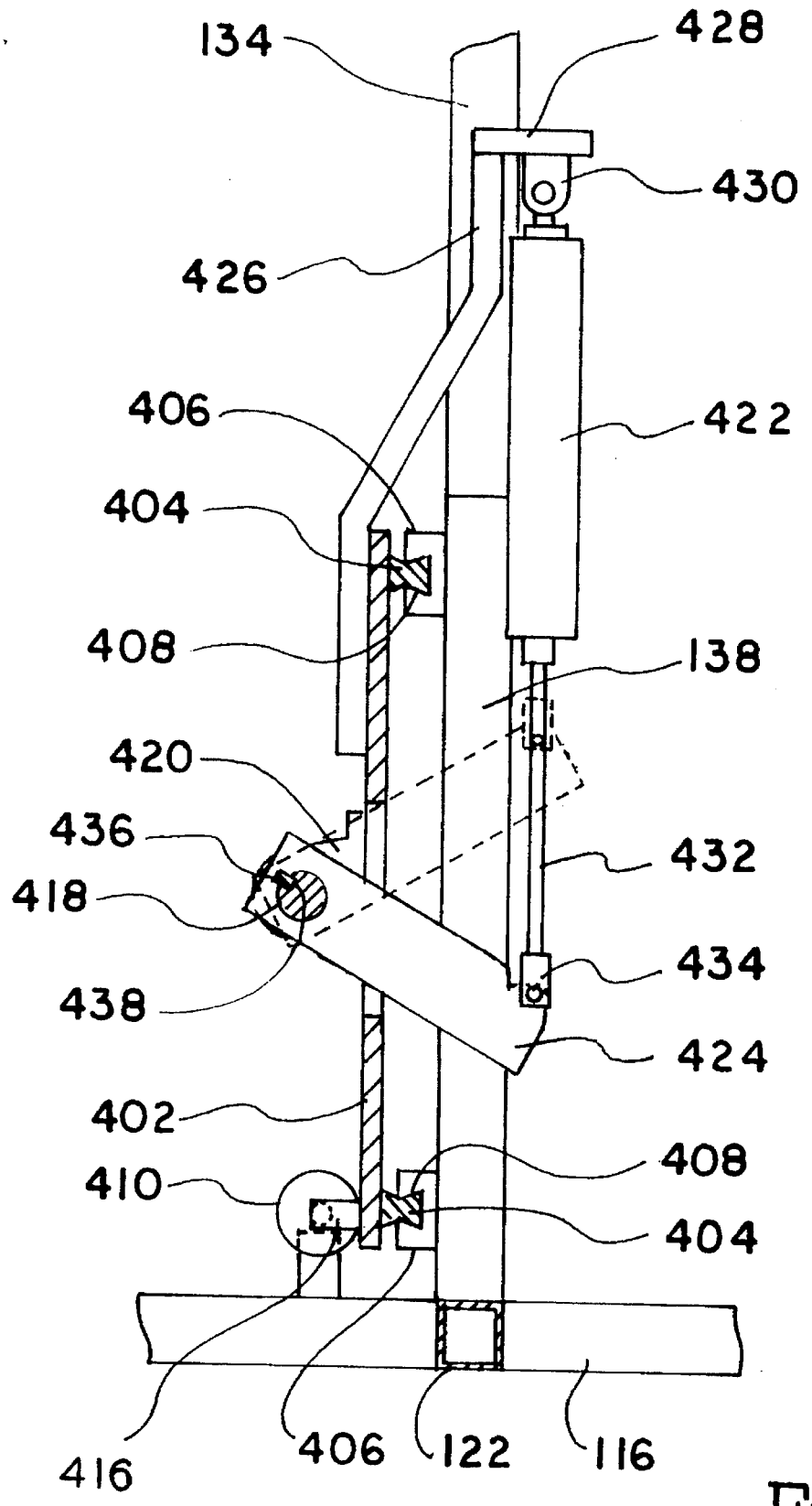
FIG. 8 is a cross-section view showing the mandrel-loading system of the winding machine.

The mandrel loading system 400 is shown in FIGS. 7 and 8. The mandrel loading system includes a slide plate 402 having parallel tracks 404 mounted to one side thereof. Guide blocks 406 are mounted to each of the support posts 132 and 134. The guide blocks 406 are formed with guide channels 408 for receiving the tracks 404 of the slide plate 402. The tracks 404 have generally V-shaped sides which interlock with the guide channels 408 in the guide blocks 406. The tracks 404 slide freely within the guide blocks 406.

The slide plate 402 is moved forward and backward by a cylinder 410. The cylinder 410 is connected at one end to a anchor bracket 412 which is secured to lower frame member 116. The cylinder rod 414 is connected to a bracket 416 mounted to the surface of the slide plate 402. The cylinder 410 moves the slide plate 402 in a direction parallel to the axis of the spindle 202.

A shaft 418 is rotatably mounted to the slide plate 402 by a pair of pillow blocks 420. The pillow blocks 420 are mounted to the surface of the slide plate 402. The axis of the shaft 418 lies parallel to the axis of the spindle 202. The shaft 418 is rotatable between an "unload" position shown in FIG. 7 and a "load" position shown in dotted lines in FIG. 7.

The shaft is rotated by a cylinder 422 which is connected to a crank arm 424. The crank arm 424 is held non-rotatable with respect to the shaft 418 by means of a key 436 and a key way 438. A cylinder support 426 is mounted to the slide plate 402. The cylinder support 426 includes a top plate 428 having an anchor bracket 430 attached thereto. The cylinder 422 is pivotally connected to the anchor bracket 430. The cylinder includes a rod 432 having a yoke 434 at its outer end. The yoke 434 is pivotally connected to the crank arm 424. When the cylinder 422 is actuated, the shaft 418 is rotated about its longitudinal axis to move the swing arm assembly 440 between its "unload" position shown in FIG. 7 and its "load" position shown in dotted lines in FIG. 7.

The swing arm assembly 440 is mounted on the end of the shaft 418. The swing arm assembly 440 includes a swing arm 442 mounted to the shaft 418 at one end which supports the outer flange 234 of the mandrel 230 at its other end. The swing arm 442 is mounted to the shaft 418 by means of a sleeve 444 and a taper-lock bushing 446. One flange 234 of the mandrel is rotatably mounted on a shaft 448 at the opposite end of the swing arm 442. The shaft 448 is rotatably mounted within a bearing sleeve 450 secured to the swing arm 442.

The swing arm assembly 440 is shown in an "unload" position in FIG. 7. The swing arm assembly 440 is moved to a "load" position during a winding operation. After the winding operation is complete, the swing arm assembly 440 is moved back to the "unload" position as shown in FIG. 7 so the wound coil can be removed from the core of the mandrel. After removing the wound coil from the mandrel, the swing arm assembly 440 is moved back to the "load" position to begin the next winding operation.

Figure 9:
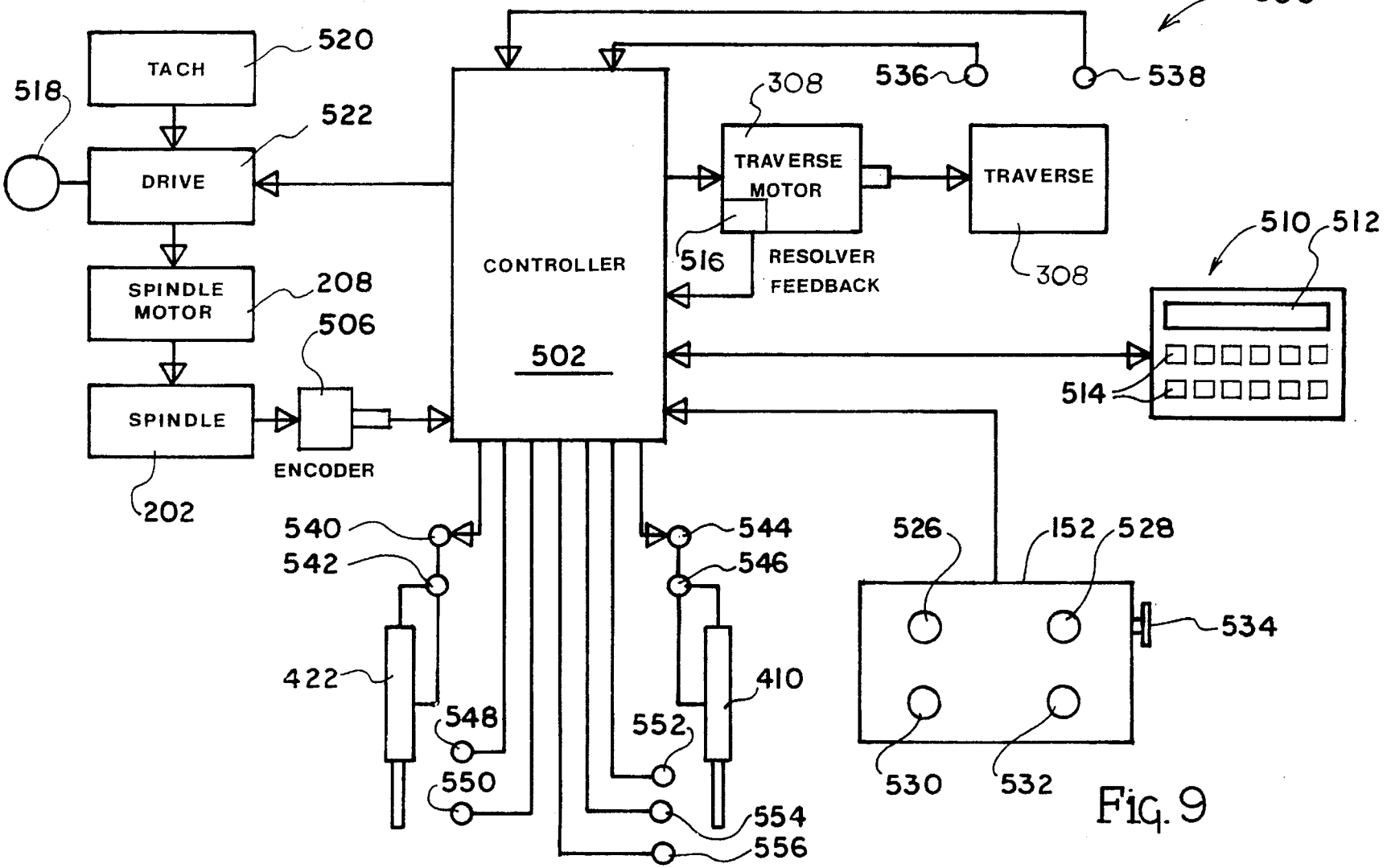
FIG. 9 is a schematic block diagram block of the control system.
Figure 10:
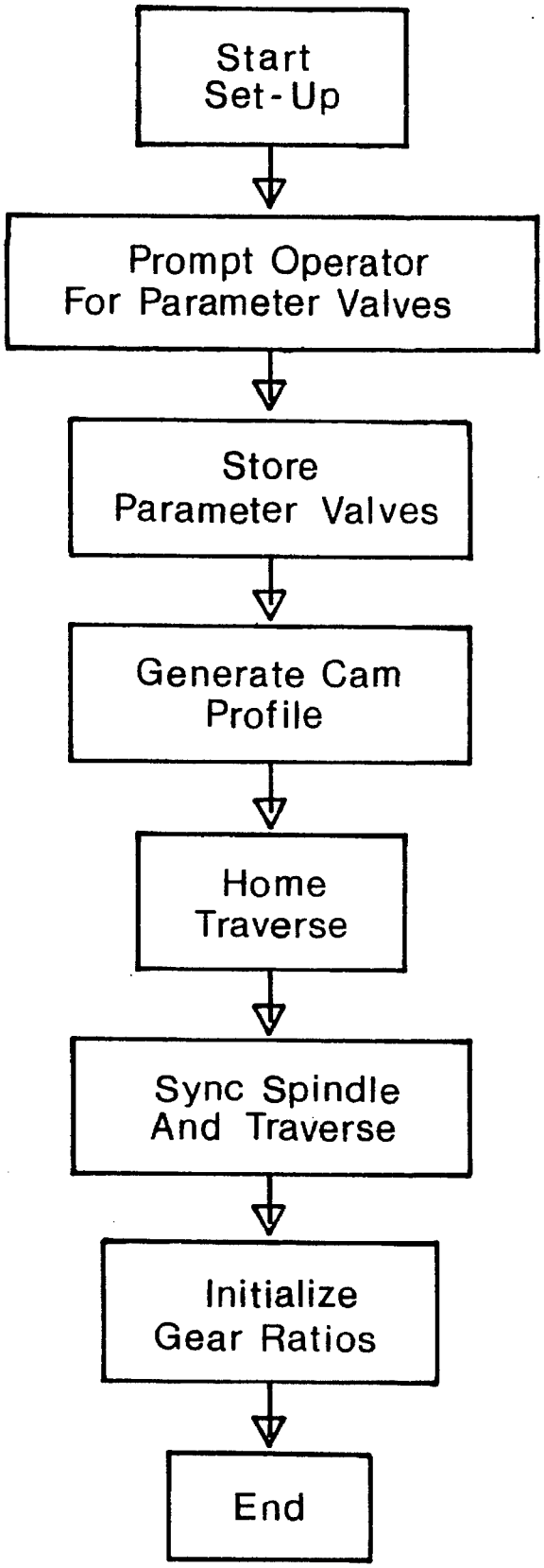
FIG. 10 is a flow diagram of the set-up program.

Referring now to FIG. 9, there is shown a schematic diagram illustrating the control system 500. The heart of the control system 500 is a programmable motion controller or central processing unit 502. The motion controller 502 is programmed to act like an electronic cam. A cam profile is stored in a table within the memory of the programmable motion controller 502. This table defines the relationship between the angular position of the spindle and the axial position of the traverse.

The spindle position is monitored by an encoder 506. The output of the encoder 506 is input to the programmable motion controller 502. This input signal is used by the controller 502 to determine the angular position of the spindle 202. The traverse is driven by an AC servo-motor 308. The servo-motor 308 includes a resolver 516 which provides a position feedback signal indicative of the position of the traverse 302. The position feedback signal from the resolver 516 is also input to the programmable motion controller 502. The controller 502 uses the angular position of the spindle 202 to calculate the corresponding traverse position based on the cam profile stored in memory. The desired traverse position is then compared to the actual traverse position as determined from the resolver feedback to generate a control signal. The control is sent to the servo-motor 308 and used to position the traverse 302.

A pair of limit switches 536, 538 are provided as a safety feature to prevent overrun to the traverse mechanism. The limit switches 536, 538 are mounted to the traverse support arm and are actuated by engagement with the traverse 302 when it overruns. When the limit switches 536, 538 are tripped by the traverse, the programmable motion controller 502 immediately stops operation of the winding machine to prevent damage to the traverse.

The programmable motion controller 502 also supports gear ratios between the spindle 202 and traverse 302. The spindle position is multiplied by a gear ratio before determining the corresponding traverse position. When a neutral gear ratio is used, the cam profile will result in the traverse moving one complete stroke for every two revolutions of the spindle 202. Because of the nature of the cross-over wind, a neutral gear ratio of is never used since the crossover points (i.e. the point where the wire crosses itself) would lie on top of one another. Instead, a gear ratio slightly more or less than the neutral ratio is used so that the cross-over points of the winding will progress around the coil being produced. The gear ratio alternates between an advance mode (slightly greater than the neutral ratio) and a retard mode (slightly lower than the neutral ratio) during the winding process. The programmable motion controller toggles the gear ratio from the advance mode to the retard mode after a predetermined number of reciprocations of the traverse 302 so that the cross-overs never advance a full 360° around the mandrel. Thus, a radial hole is formed in the package through which the inner end of the wire can be paid out.

During the winding operation, the speed of the spindle 202 is controlled so that the line speed of the wire will remain constant. Since the diameter of the coil will increase during the winding operation, it is necessary for the spindle 202 to slow down as the wind builds up to maintain a constant line speed. To maintain the line speed constant, the line makes contact with the surface of a roller which drives a tachometer 520. The signal from the tachometer 520 is fed to a frequency controller 522 and compared to a desired speed setting which is input by the operator. The frequency controller 522 compares the tachometer signal with the desired speed setting and outputs a frequency signal to drive the spindle motor 208. The speed setting is set by means of a dial 51 8 on the control panel 152. If the tachometer signal exceeds the desired speed setting, the frequency signal is reduced to slow down the spindle 202. On the other hand, if the tachometer signal is below the desired speed setting, the frequency signal is increased to increase the speed of the spindle motor.

The mandrel loading system is also controlled by the controller 502. Solenoids 540 and 544 are actuated by the controller 502 and control respective spool valves 542 and 546. The spool valves 542 and 546 direct air to respective cylinders 422 and 410. As previously described, cylinder 410 moves the slide plate inwardly and outwardly relatively to the frame 100. Limit switches 552, 554 and 556 monitor the axial position of the swing arm assembly. Limit switch 552 is turned on when the swing arm is moved in. Limit switch 556 is turned on when the swing arm is moved out. Limit switch 554 is disposed intermediate switches 552 and 556 and indicates when the swing arm is in a load position.

Cylinder 422 rotates the swing arm upwardly and downwardly. Limit switch 548 detects when the swing arm is in a down position and limit switch 550 detects when the swing arm is in the up position. When both the limit switches 550 and 554 are turned on, the swing arm is in a load position.

In addition to the controls described above, there are provided a number of operator controls. The operator controls include a start button 526, a stop button 528, a load button 530, and an unload button 532. A safety button 534 is provided for enabling the load button 530 and unload button 532. These controls are mounted in a control panel 152 at the end of the traverse support arm 140.

The start button 526 and stop button 528 perform the expected functions of starting and stopping the winding machine. The unload button 532 actuates the mandrel loading system to move the swing arm to the unload position as shown in FIG. 7. The load button 530 actuates the mandrel loading system to cause the swing arm to move back to the load position. The safety button 534 is provided as a safety feature and must be depressed to enable the load and unload buttons. Thus, two hands are required in order to actuate the mandrel loading system. This feature prevents the operator from inadvertently actuating the loading mechanism.

The remaining controls include a key pad 510 for use during the set-up sequence. The key pad 510 is used to enter operating parameters including the spool offset, the spool width, the gear toggle count, the advance, and the retard. Also, optional parameters include the cable diameter and the package density. The key pad 510 includes a display 512 to display messages and a plurality of keys 514 for entering data.

To use the winding machine 10 of the present invention, the operating parameters are first entered by the user using the keypad 510. The set-up program is shown schematically in FIG. 9. After the user starts the set-up program, the controller prompts the operator to enter values for the operating parameters. Those parameters include the spool offset, the spool width, the toggle count, the advance and the retard. The spool offset refers to the axial position of the spool with regard to a fixed reference. The spool width is the length of the spool in the axial direction. The toggle count is the number of reciprocations of the traverse after which the gear ratio is toggled between the advance and retard modes. The advance and retard are numbers used to increase or decrease the gear ratio respectively. Values are entered by the operator for each of these parameters and then stored. The values entered for spool width and spool offset are then used by the controller 502 to generate the cam profile. The spool offset and spool width define the stroke of the traverse. The spool offset defines the beginning point of the traverse's stroke. The spool width is added to the spool offset to define the ending point of the traverse's stroke.

To generate a profile of the traverse motion, the rotation of the spindle is divided into 128 equal increments of approximately 2.81°. The program then generates a table defining the traverse position with respect to the angular position of the spindle for each increment. This data constitutes the cam profile which is stored in the controller's memory.

Figure 11:
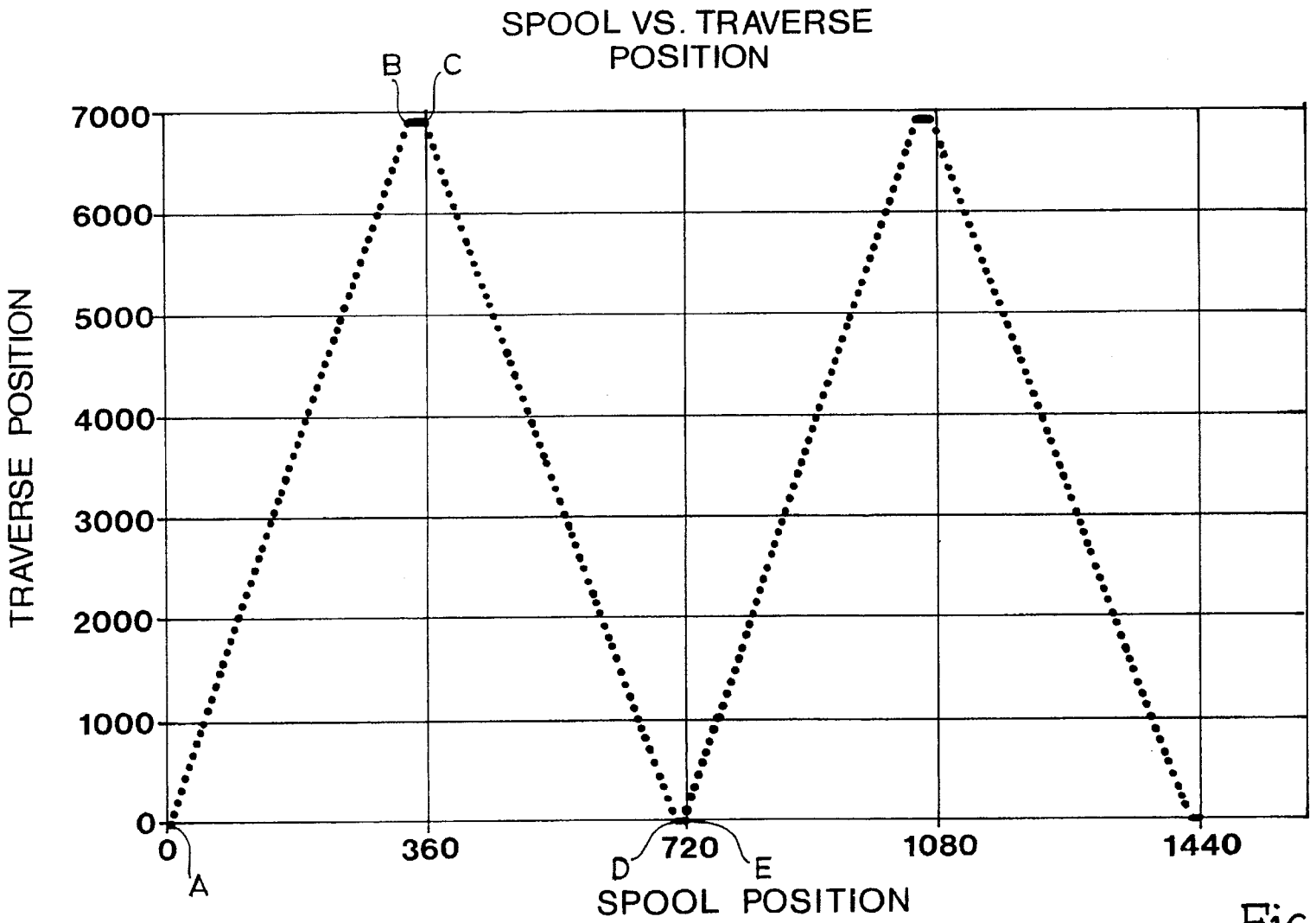
FIG. 11 is a graph of a typical cam profile generated by the set-up program.

FIG. 11 is a graph of a typical cam profile. The graph shows the traverse position with respect to the angular position of the spindle. The graph is a modified triangular wave formed in which the peaks of the triangles are truncated. The motion of the traverse is linear between points A and B and points C and D. Between points B and C and points D and E, the traverse does not move. Thus, the traverse 302 will dwell at each end of its stroke for a brief period. The starting position of the traverse is determined by the spool offset. The distance traveled by the traverse 302 between points A and B represents the spool width. This distance is entered by the user in a standard unit of measurement such as inches and is converted to counts by the controller 502. Counts is a unit used by the controller 502 for its internal operations. After the cam profile is generated, the controller 502 moves the traverse to a home position, synchronizes the spindle and traverse positions, and initializes the gear ratio.

After the start-up sequence is completed, the winding machine is ready for use. The operator loads the outer flange 234 by simultaneously pressing the load button 530 and the safety button 534. Pressing both buttons simultaneously requires the use of both hands by the operator assuring that the operator will not get inadvertently injured by the loading mechanism. After the mandrel is moved to the "load" position, the end of the line is inserted through the line guide tube 332 on the traverse 302 and secured to the mandrel 230. This is usually done by inserting the end of the line into the core in a manner well-known to those skilled in the art. After the end of the line is secured to the mandrel, the "start" button 526 is pressed to begin operation of the winding machine.

Figure 12A:
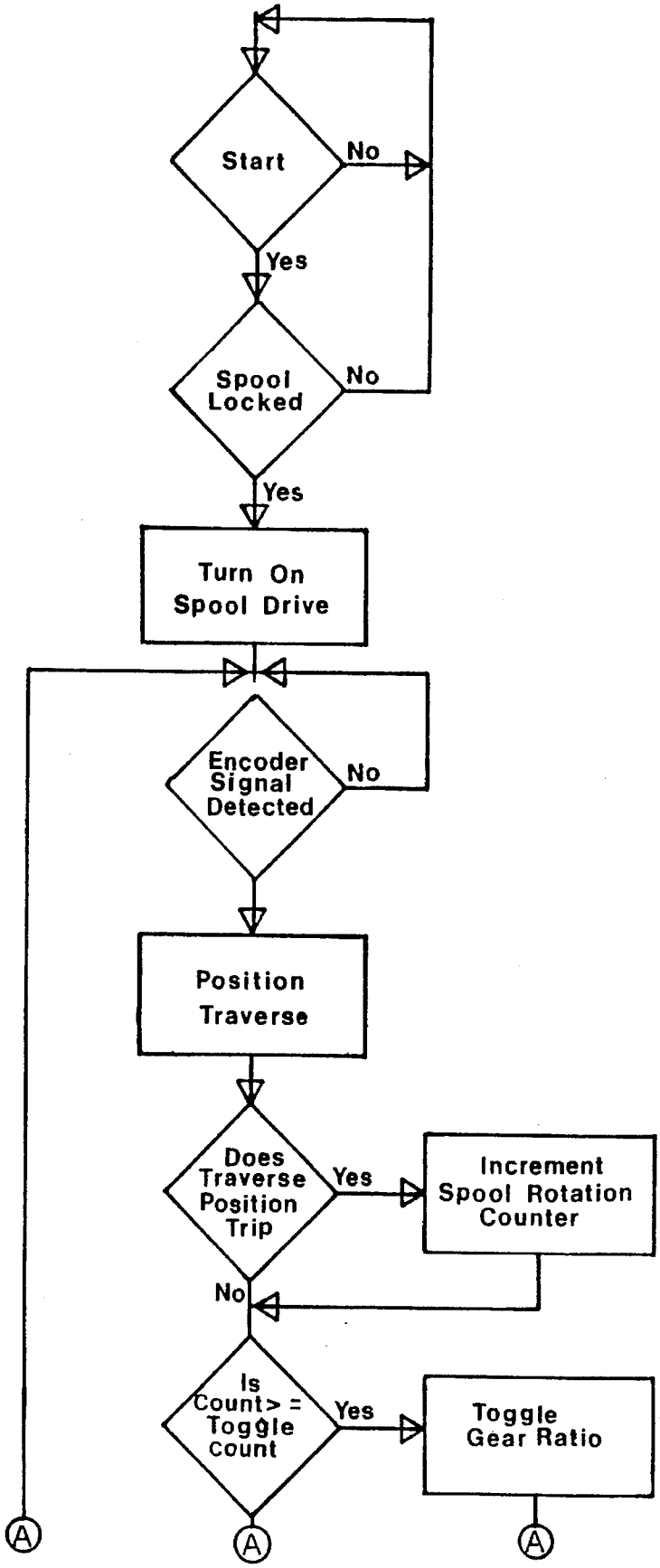
FIGS. 12A and 12B are flow diagrams of the main program.
Figure 12B:
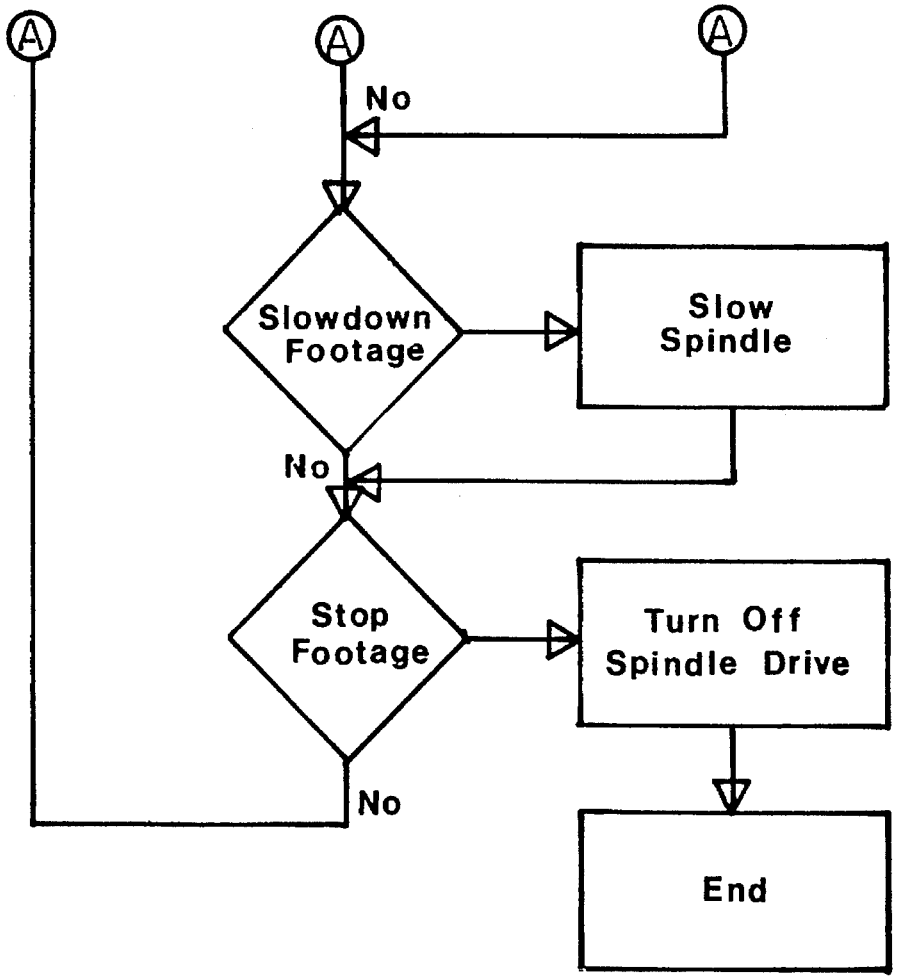

FIGS. 12A and 12B are flow diagrams illustrating the operation of the winding machine during "run" mode. When a start signal is received, the controller checks to make sure the spool is locked in a load position, and then enables the spindle drive. Each time a signal from the master encoder is detected, the controller 502 positions the traverse by issuing a position command signal to the traverse motor. The controller 502 then checks to determine if the servo-motor count equals a predetermined number. If so, the processor increments the counter and then compares the counter value to the toggle count. If the count is equal to the toggle count, the controller 502 toggles the gear ratio between its retard mode and its advance mode. This sequence is repeated for each rotation signal produced by the encoder.

During the winding process, the controller 502 monitors the number of feet of line which is wound onto the spindle and automatically stops the spindle motor 208 after a predetermined amount of line is wound on the spool 230. Also, the controller 502 slows down the spindle motor 208 for a predetermined period before the end of the winding process. For example, if the line is to be wound in 1000 ft. packages, the controller 502 would operate normally while the first 950 ft. is wound. For the last 50 ft. of line, the controller 502 slows down the spindle motor 208. After the last 50 ft. are wound onto the spool, the controller 502 turns off the spindle drive 522 and ends the winding process.

After the package is wound, the operator unloads the wound package from the mandrel by simultaneously pressing the unload button 532 and the safety button 534. The swing arm assembly 440 then moves to a "unload" position allowing the operator to remove the package from the spool 230. After the package is removed, the load and safety buttons 530 and 534 are simultaneously pressed to move the swing arm 440 back to a "load" position and the winding process is repeated.

Figure 13A:
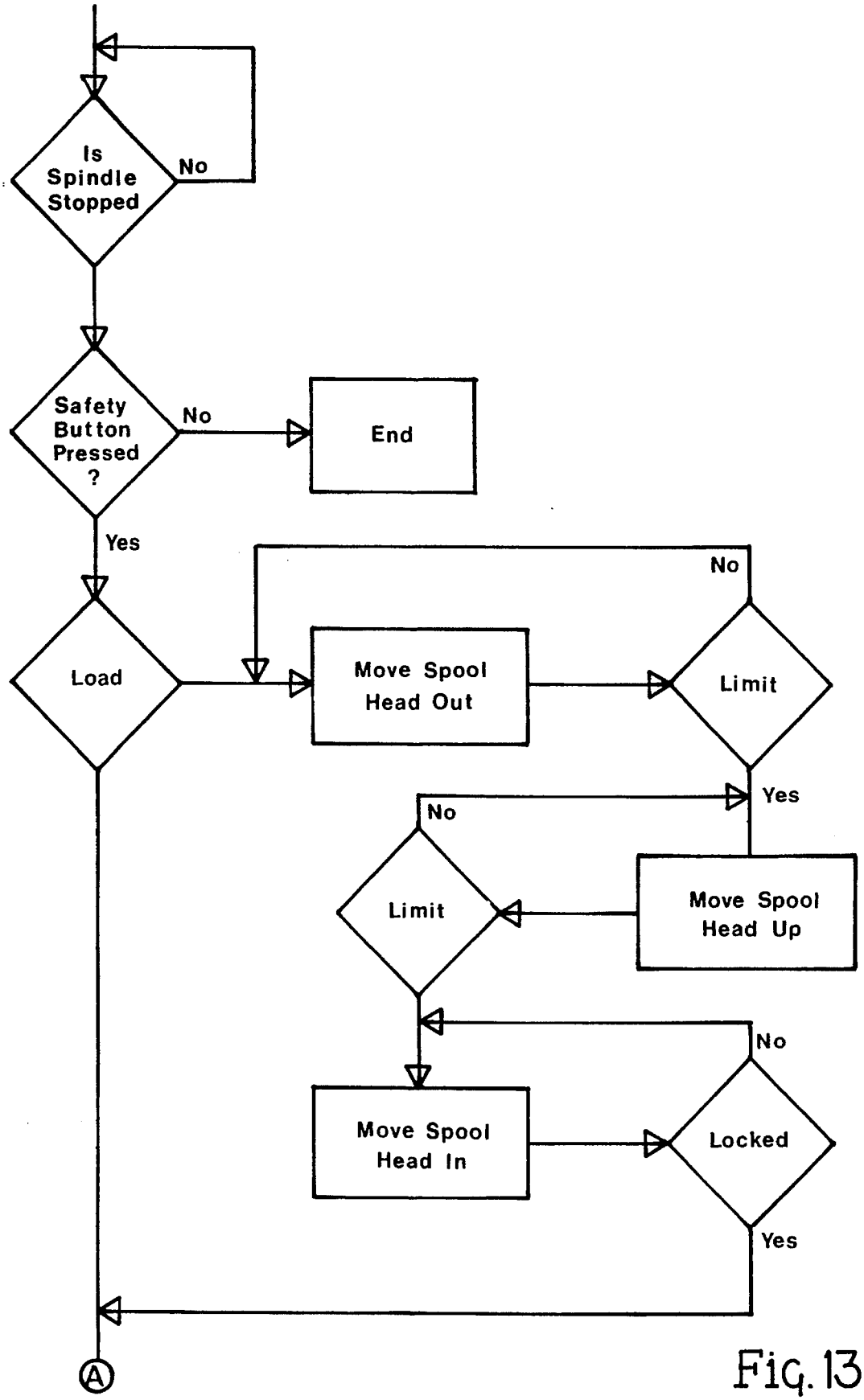
FIGS. 13A and 13B are flow diagrams of the load/unload program.
Figure 13B:
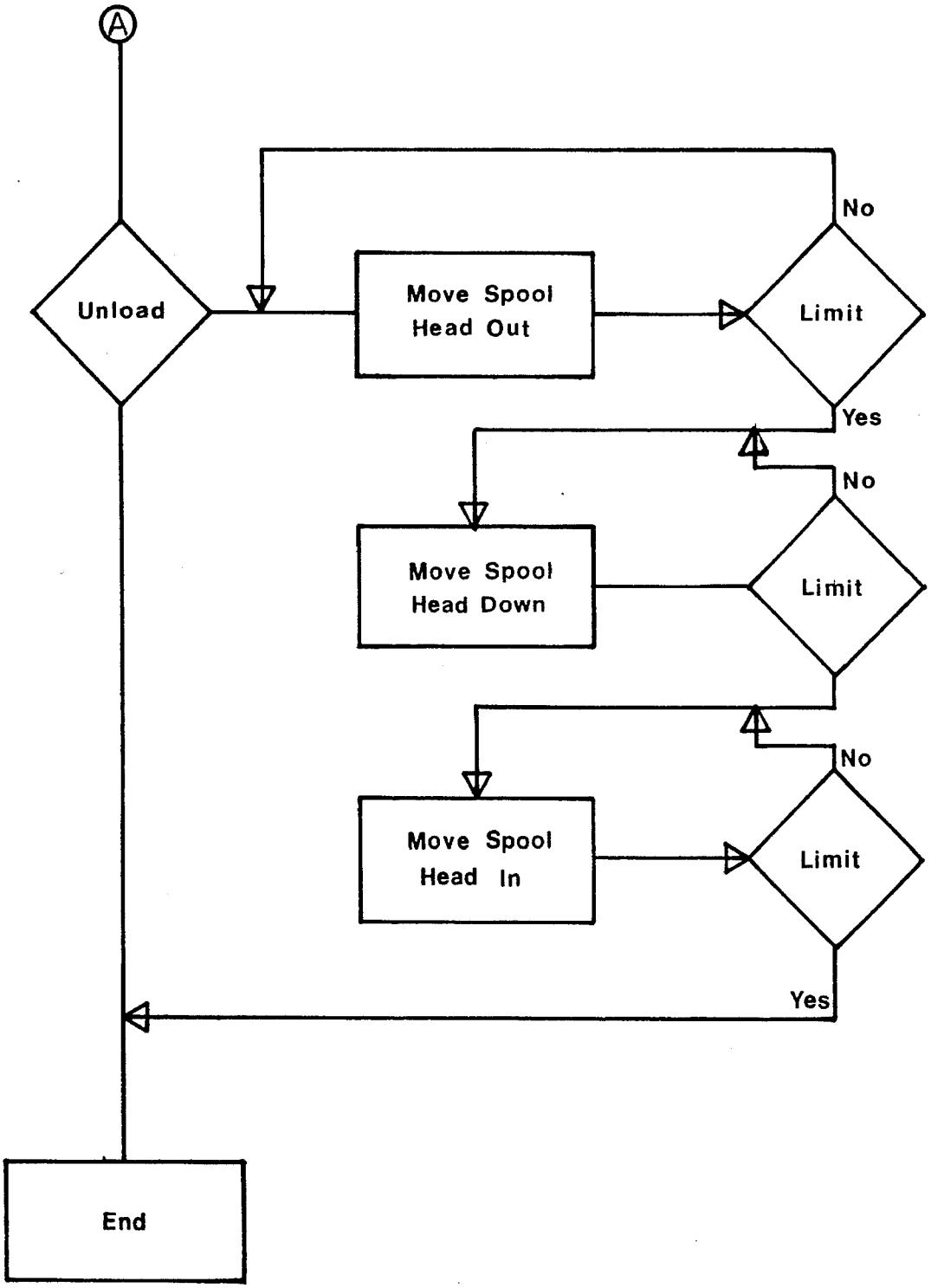

FIGS. 13A and 13B are flow diagrams illustrating the operation of the controller during the loading and unloading sequences. When the controller 502 receives a command to load or unload the mandrel, it first checks to make sure the spindle 202 is stopped. Next, the controller checks to make sure the safety button 534 is pressed. If not, the load/unload sequence is stopped.

If a load command is received and the safety button 534 is pressed, the controller 502 first moves the spindle out by actuating cylinder 410. Limit switch 556 detects when the spindle is extended. The controller then rotates the swing arm assembly 440 down by actuating cylinder 422. Limit switch 548 detects when the swing arm assembly 440 is in a down position. Finally, the controller 520 moves the swing arm assembly 440 in by again actuating cylinder 410. Limit switch 552 detects when the swing arm assembly 440 is retracted.

The load command causes the swing arm assembly 440 to move in the opposite direction. First, the swing arm assembly 440 is extended until detected by limit switch 556. Next, the swing arm assembly 440 is raised until detected by limit switch 550. Finally, the swing arm assembly 540 is moved in until the load position is reached. In the load position, the outer flange 234 is engaged with the core 236 of the mandrel. The load position is detected by limit switch 554.

The winding machine of the present invention has numerous advantages over the prior art winding machines. First, because the winding machine of the present invention utilizes an "electronic cam", the cam profile can be changed without machining new parts, and without dissembling the machine. A new cam profile can be loaded quickly so that down time of the machine is reduced. Also, the operating parameters used by the programmable motion controller are independent of one another so that changes in any single operating parameter will produce predictable results. This greatly reduces the time needed to set-up a winding machine when beginning a new operation. Finally, the winding machine of the present invention produces a radial hole which is more uniform in size from one package to the next and which is free of any curvature.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A winding machine for winding a line to form a package comprising:

(a) a spindle;

(b) a spool mounted on the spindle;

(c) a motor for driving the spindle;

(d) a reciprocating traverse for guiding the line onto the spool;

(e) a motor for driving the traverse;

(f) control means for controlling the position of the traverse with respect to the spindle to wind a line in a generally cross-over pattern about the spindle with the cross-over points in each winding progressing around the spool, the control means including:

(1) means for storing a cross-over profile that defines the relative position of the traverse with respect to the angular position of the spindle during the winding process;

(2) a sensor for sensing the angular position of the spindle; and (3) processing means responsive to the spindle sensor for setting the desired traverse position based on the stored cross-over profile and outputting a control signal to the traverse drive motor for positioning the traverse at the desired position.

2. The winding machine of claim 1 further including electronic gear means for selectively advancing and retarding the motion of the traverse with respect to the spindle to cause the cross-over points of the winding to progress around the spool.

3. The winding machine of claim 2 further including means for toggling the gear means between its advance and retard modes after completion of a predetermined number of reciprocations of the traverse.

4. The winding machine of claim 3 wherein the predetermined number of reciprocations is selected so that the cross-overs do not progress a full 360° around the spool and a radial hole is formed in the package of line being formed.

5. The winding machine of claim 1 further including means for varying the rotational speed of the spindle to maintain the line speed of the line constant during the winding process.

6. The winding machine of claim 5 wherein the speed control means comprises a speed sensor for detecting the line speed of the line, and a spindle drive operatively connected to the spindle motor and responsive to the speed sensor for varying the speed of the spindle motor in response to changes in the line speed of the line.

7. The winding machine of claim 1 further including a limiting device for directing the control means to stop operation of the winding machine machine in response to the limit device detecting an overrun of the reciprocating traverse to prevent damage to the traverse.

8. The winding machine of claim 1 wherein the control means monitors the length of line wound on the spool and stops the spindle motor after a predetermined length of line is wound on the spool.

9. The winding machine of claim 8 wherein the control means slows down the spindle motor for a predetermined period before the spindle motor is stopped.

10. A winding machine for winding a line onto a spool to form a package having a plurality of cross-over windings with each winding having at least one cross-over point, comprising:

(a) a spindle on which the spool is mounted;

(b) a motor for rotating the spindle;

(c) a reciprocating traverse that moves in synchronization with the rotation of the spindle;

(d) control means for setting the position of the traverse with respect to the spindle by comparing positions of the spindle and the traverse to a stored cross-over profile; and (e) means for varying the rotational speed of the spindle to maintain a constant line speed during the winding of the package.

11. The winding machine of claim 10 wherein the speed control means comprises a speed sensor for detecting the line speed, and a frequency controller operatively connected to the spindle motor and responsive to the speed sensor for varying the speed of the spindle motor in response to changes in the line speed.

12. The winding machine of claim 11 wherein the speed control means also comprises means for setting a desired line speed, and wherein the frequency controller also compares the detected line speed with the desired line speed.

13. A method for winding an advancing line onto a spool to form a package having a plurality of cross-over windings with each winding having at least one cross-over point, comprising:

(a) rotating the spool;

(b) varying the position of the advancing line in predetermined relationship with the angular position of the spool to form a plurality of cross-over windings on the spool;

(c) wherein the step of varying the position of the line includes:

(1) generating a cross-over profile that defines the relative position of the line with respect to the angular position of the spindle during the winding process;

(2) storing the cross-over profile;

(3) generating a periodic rotation signal indicative of the angular position of the spindle;

(4) setting the position of the line corresponding to the angular position of the spindle in the stored cross-over profile in response to the detection of each rotation signal; and (5) positioning the line at the set position.

14. The method of claim 13 further including the step of setting a gear ratio to change relative position of the line with respect to the angular position of the spindle to cause the cross-over points of the windings to progress circularly around the spool.

15. The winding method of claim 14 further including the step of changing the gear ratio between an advance mode and a retard mode upon the occurrence of a predetermined number of rotations of the spool to cause the cross-over points to advance first in one direction and then in the opposite direction.

16. The winding method of claim 15 further including the step of forming a radial hole in the package by changing the gear ratio between an advance mode and a retard mode before the cross-over points progress a full 360° around the spool.

17. The winding method of claim 13 further including the step of varying the rotational speed of the spindle during the winding process to maintain the speed of the line constant during a portion of the winding process.

18. A winding machine comprising:

(a) a spindle;

(b) a mandrel mounted on the spindle on which wire is wound;

(c) a motor for driving the spindle;

(d) a reciprocating traverse for guiding the wire onto the mandrel;

(e) a servo-motor for driving the traverse;

means for storing a cross-over profile that defines the relationship between the traverse position and the angular position of the spindle;

(g) means for providing a rotation signal corresponding to the angular position of the spindle;

(h) means for providing a position feedback signal corresponding to the position of the traverse;

(i) means for setting the traverse position based on the rotation signal, the position feedback signal and the cross-over profile and for generating a control signal; and (j) wherein the servo-motor is responsive to the control signal to position the traverse.

19. The winding machine of claim 18 further including electronic gear means for selectively advancing and retarding the motion of the traverse with respect to the spindle to cause the cross-over points of the winding to progress around the mandrel.

20. The winding machine of claim 19 further including means for toggling the gear means between its advance and retard modes after completion of a predetermined number of reciprocations of the traverse.

21. The winding machine of claim 20 wherein the predetermined number of reciprocations is selected so that the cross-over points do not progress a full 360° around the mandrel and a radial hole is formed in the package of wire being formed.

22. The winding machine of claim 18 further including means for varying the rotational speed of the spindle to maintain the line speed of the wire constant during the winding process.

23. The winding machine of claim 22 wherein the speed control means comprises a speed sensor for detecting the line speed of the wire; and spindle drive operatively connected to the spindle motor and responsive to the speed sensor for varying the speed of the spindle motor in response to changes in the line speed of the wire.

* * * * *